US008640872B2

(12) United States Patent
Archambault et al.

(10) Patent No.: US 8,640,872 B2
(45) Date of Patent: Feb. 4, 2014

(54) EGG CONTAINER WITH STACK-SPACING SYSTEM

(75) Inventors: Germain Archambault, Saint-Hubert (CA); François Blanchette, Mirabel (CA); François St-Louis, Sainte-Julie (CA)

(73) Assignee: Pactiv Canada Inc., Scarborough, Ontario (CA)

( * ) Notice: Subject to any disclaimer, the term of this patent is extended or adjusted under 35 U.S.C. 154(b) by 181 days.

(21) Appl. No.: 12/726,634

(22) Filed: Mar. 18, 2010

(65) Prior Publication Data

US 2011/0226656 A1 Sep. 22, 2011

(51) Int. Cl.
*B65D 85/32* (2006.01)

(52) U.S. Cl.
USPC ..... 206/521.1; 206/521.8

(58) Field of Classification Search
USPC ..... 206/521.1, 521, 521.15, 521.3, 521.6, 206/521.8
See application file for complete search history.

(56) References Cited

U.S. PATENT DOCUMENTS

| | | | | | |
|---|---|---|---|---|---|
| 2,600,130 | A * | 6/1952 | Schilling | ..... | 206/521.8 |
| 2,843,304 | A * | 7/1958 | Reifers | ..... | 206/521.1 |
| 3,563,446 | A * | 2/1971 | Lake et al. | ..... | 206/521.8 |
| 3,643,855 | A * | 2/1972 | Donaldson | ..... | 206/521.1 |
| 3,790,062 | A * | 2/1974 | Boyd | ..... | 206/521.1 |
| 4,609,141 | A * | 9/1986 | Lake | ..... | 206/521.1 |
| 4,795,080 | A * | 1/1989 | McIntyre | ..... | 206/521.1 |
| D306,138 | S * | 2/1990 | Congleton et al. | ..... | D9/757 |
| 7,255,231 | B2 * | 8/2007 | Andrews et al. | ..... | 206/521.1 |
| 2005/0097009 | A1 * | 5/2005 | Reeves-Collins et al. | ..... | 705/27 |
| 2006/0060493 | A1 * | 3/2006 | Marshall | ..... | 206/521.1 |

* cited by examiner

*Primary Examiner* — Steven A. Reynolds
*Assistant Examiner* — Ernesto Grano
(74) *Attorney, Agent, or Firm* — Baker Botts L.L.P.

(57) ABSTRACT

A container for receiving frangible items comprising a sheet of polymer formed into: a base portion and at least one cover portion with a hinge between the base portion and the cover portion. Abutment spacer are formed at an edge between the peripheral walls and the top wall and each comprise an abutment surface projecting into the concavity from one of the peripheral walls, and support walls relating the abutment surface to the top wall, with at least one of the support walls being in an acute angle relation with the top wall of the cover portion. Alignment channels are in at least one of the peripheral walls defining an alignment protrusion through the sheet of polymer, the alignment channel/protrusion being oriented vertically for guiding the nesting of an upper one of the cover portion descending into a lower one of the cover portion.

13 Claims, 6 Drawing Sheets

EGG CONTAINER WITH STACK-SPACING SYSTEM

FIELD OF THE APPLICATION

The present application relates to containers for receiving frangible objects such as eggs, and to structural components of such containers for allowing the stacking of such containers in an opened position.

BACKGROUND OF THE ART

Egg containers of all kinds have been developed for the transportation and sale of frangible items such as eggs. As eggs are relatively fragile, the egg containers must protect the eggs from the various manipulations involved from the packaging of the eggs to the consumer's refrigerator.

One significant improvement in egg containers is the use of thermoformed plastics as material for the egg containers. Thermoformed plastics are typically transparent, which allows the eggs to be visible, and are relatively inexpensive to produce. As they can inspect the eggs by seeing through the material of the egg container, the consumers do not need to open the egg container, as is the case with cardboard egg containers, for instance. In the case of cardboard boxes, it may occur that the boxes are not closed properly after inspection. This may cause the breakage of eggs if the improperly closed egg container is subsequently manipulated by another consumer.

One of the advantages with containers of thermoformed plastics pertains to the stacking of the containers in an open position. Containers in the open position may be nested one into the other to form stacks requiring a relatively small volume when compared to stacks of closed containers. However, the separation of containers nested one into the other is often performed by automated equipment. Accordingly, containers must have components to ensure that stacks of open containers are upright. Moreover, an equidistant spacing between a plurality of open containers nested one into the other facilitates their separation by the automated equipment.

SUMMARY OF THE APPLICATION

It is therefore an aim of the present disclosure to provide a container for frangible items addressing issues associated with the prior art.

Therefore, in accordance with the present application, there is provided a container for receiving frangible items comprising: a sheet of polymer formed into: a base portion having a plurality of item-receiving cavities for supporting frangible items; at least one cover portion having at least one item-covering concavity for covering the frangible items, the cover portion having a generally flat top wall and peripheral walls concurrently defining the at least one item covering concavity; a first hinge between the base portion and the cover portion for rotating the cover portion onto the base portion to hold the frangible items captive in the item-receiving cavities; at least one abutment spacer formed at an edge between the peripheral walls and the top wall, the at least one abutment spacer comprising an abutment surface projecting into the concavity from one of the peripheral walls, and support walls relating the abutment surface to the top wall, with at least one of the support walls being in an acute angle relation with the top wall; at least one alignment channel in at least one of the peripheral walls defining an alignment protrusion through the sheet of polymer, the alignment channel/protrusion being oriented vertically for guiding the nesting of an upper one of the cover portion descending into a lower one of the cover portion, by the alignment protrusion of the upper one received in the alignment channel of the lower one, when a stack of the containers in an opened state is formed, whereby a spacing between nested containers is defined by the abutment spacers of the upper one seated on the abutment spacers of the lower one.

Further in accordance with the present application, there is provided a container for receiving frangible items comprising: a sheet of polymer formed into: a base portion having a plurality of item-receiving cavities for supporting frangible items, with a post centered between each set of four of the item-receiving cavities, the post projecting upwardly from the base portion to support a structural component of the cover portion when the container is closed; at least one cover portion having at least one item covering concavity for covering the frangible items, and a structural component extending into the concavity for contacting the post when the container is closed; a first hinge between the base portion and the cover portion for rotating the cover portion onto the base portion to hold the frangible items captive in the item-receiving cavities; spacers formed between at least one of the posts and the four item-receiving cavities surrounding the post, the spacers each defining a subcavity on one side of the sheet of polymer and a bump on the other side of the sheet of polymer, the spacers having a wider central portion for narrower ends along a vertical axis of the container, such that the nesting of an upper one of the base portion descending into a lower one of the base portion results in the spacers of the upper one seated on the spacers of the lower one when a stack of the containers in an opened state is formed, whereby a spacing between nested containers is defined by the spacers of the upper one seated on the spacers of the lower one.

DESCRIPTION OF THE PREFERRED EMBODIMENTS

Figure 1:
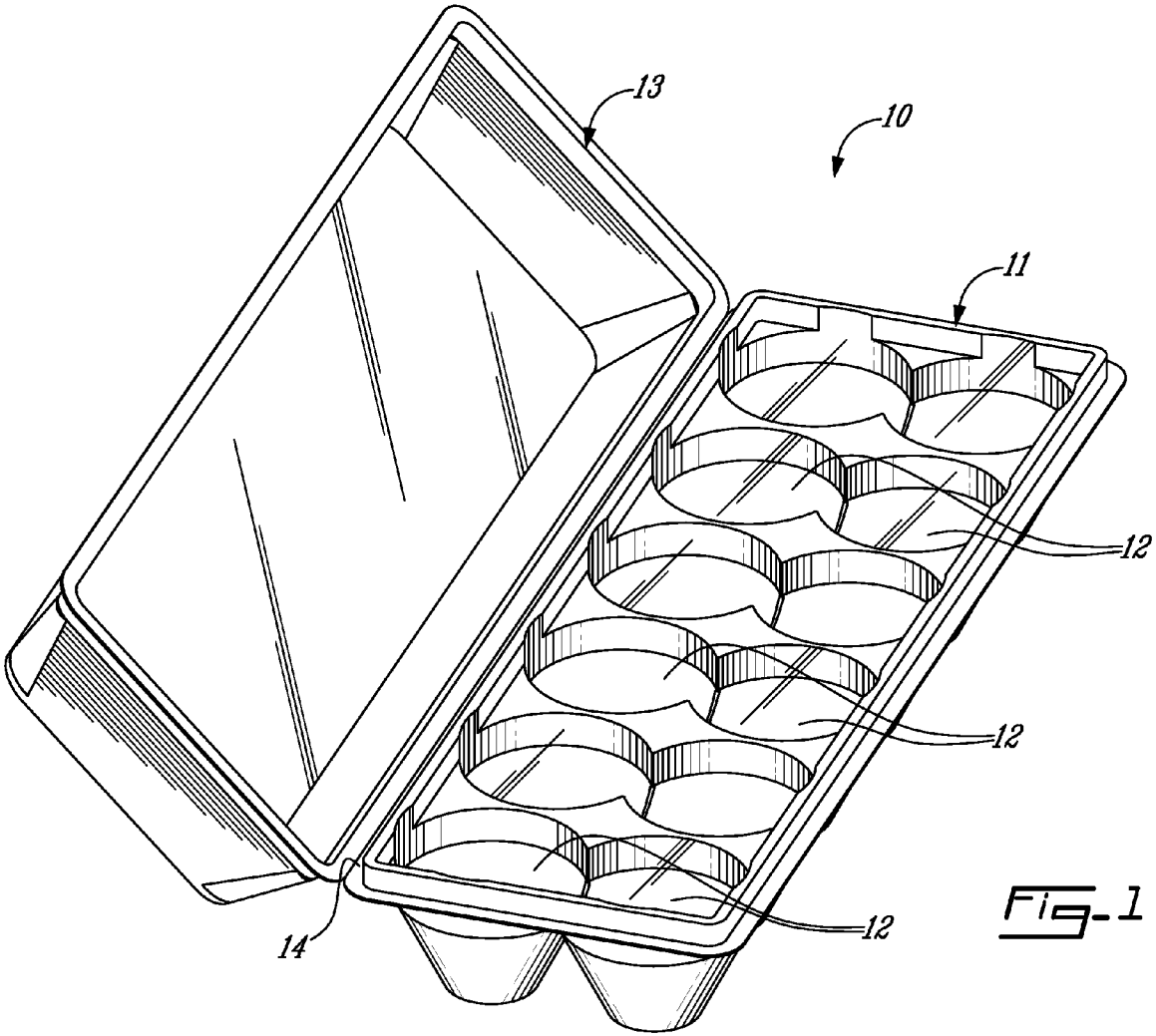
FIG. 1 is a schematic perspective view of a two-fold egg container.

Referring to the drawings and more particularly to FIG. 1, a container for frangible items is generally shown at 10, and is referred to as an egg container. The egg containers described hereinafter are preferably made of transparent or translucent plastics, for instance, using a thermoforming process or other molding process. In one embodiment, the egg containers are formed from a single, flat sheet of plastic. Other materials and/or processes may be used as well. The containers described hereinafter may be used to contain eggs or any other frangible items (e.g., tomatoes), in any suitable number (e.g., 6, 12, 18, 24).

The egg container 10 of FIG. 1 is a two-fold egg container, as it has two portions hinged to one another. The egg container 10 has a base portion 11 having a plurality of egg-receiving cavities 12 (e.g., 6, 12, 18, 24,or any other suitable number), with each cavity 12 supporting an egg. A top cover portion 13 is hinged to the base portion 11 by hinge 14, in a longitudinal dimension of the egg container 10. The top cover portion 13 presents a flat top surface part of a top wall as in FIG. 1, with or without strengthening components (e.g., arches, posts). Although not shown, mating connectors or any other suitable type of connectors are provided on the periphery of the base portion 11 and top cover portion 13 for interlocking them when the egg container 10 is closed.

Figure 2:
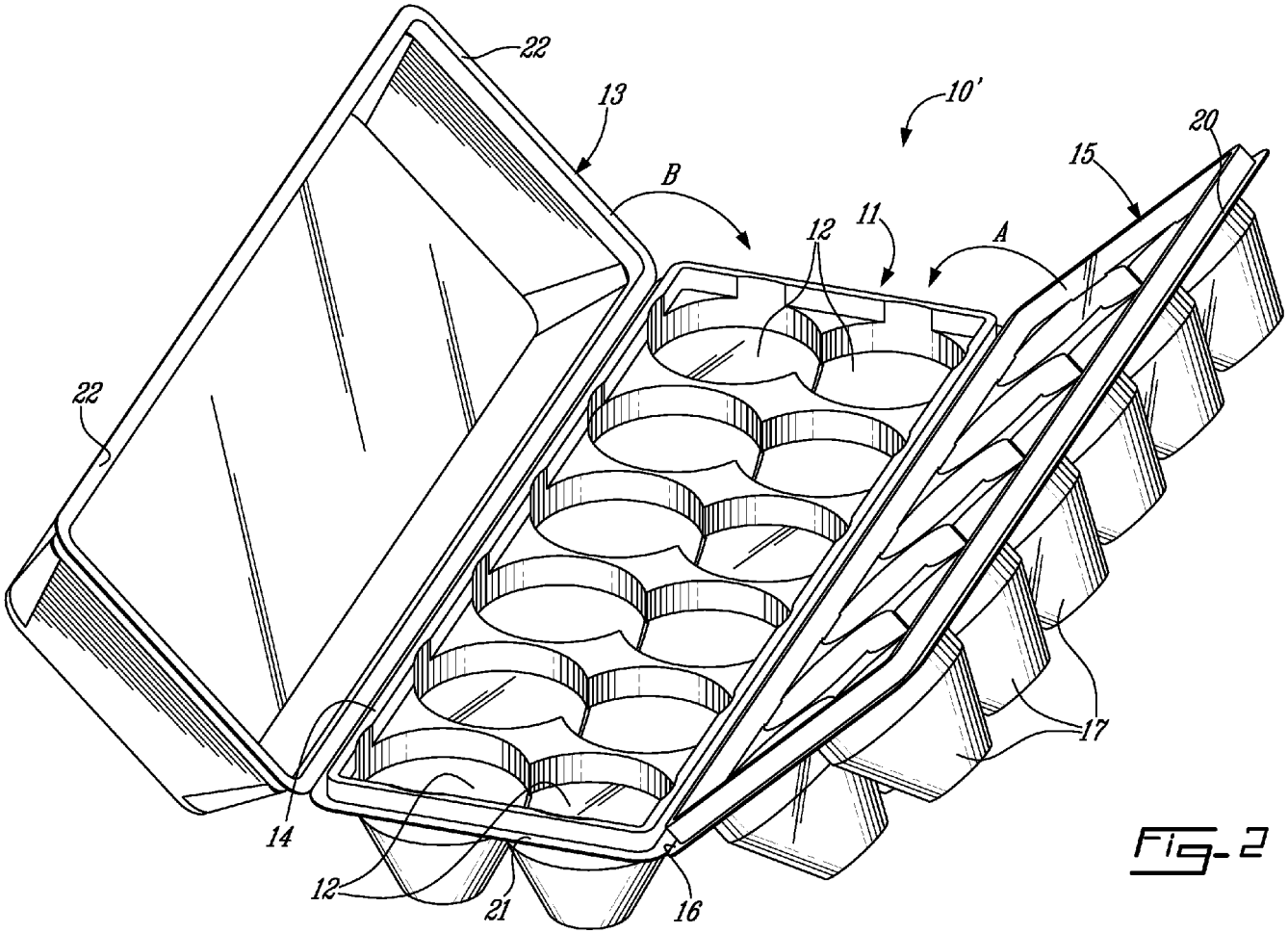
FIG. 2 is a schematic perspective view of a three-fold egg container.

Referring to FIG. 2, a three-fold egg container is generally illustrated at 10'. The egg container 10' is similar to the egg container 10 of FIG. 1, but has an intermediate cover portion 15. The intermediate cover portion 15 is hinged to the base portion 11 by hinge 16, in a longitudinal dimension of the egg container 10'. The hinges 14 and 16 are preferably on opposite edges of the base portion 11. The intermediate cover portion 15 typically has egg cavities 17 to cover a top portion of the eggs supported by the egg-receiving cavities 12. Although not shown, mating connectors or any other suitable type of connector are provided on the periphery of the top cover portion 13 and the intermediate cover portion 15 for interlocking them when the egg container 10' is closed.

The egg containers 10/10' of FIGS. 1 and 2 may have peripheral flanges 20-22, that lie one against the other when the egg containers 10/10' is closed. The flanges 20-22 provide structural stability to stacks of closed containers, by spreading the weight between base portion 11, top cover portion 13 and intermediate cover portion 15, if applicable.

In order to close the egg container 10', the intermediate cover portion 15 is firstly hinged into contact with the base portion 11, as illustrated by arrow A. The top cover portion 13 is then hinged onto the intermediate cover portion 15, as illustrated by arrow B.

The egg containers of the present disclosure may contain any suitable number of item-receiving cavities. One suitable material for the egg containers of the present application is polyethylene terephthalate (PET). PET has many advantages, as this material can be transparent or opaque and can be produced at high volume and at low cost. Wall thicknesses of PET cases in a contemplated embodiment are 0.0175 inch in thickness, but other thicknesses as low as 0.012 to as high as 0.022 inch are also contemplated. However, this thickness may vary, for instance, once the sheet is formed into the egg container 10/10'.

Figure 3:
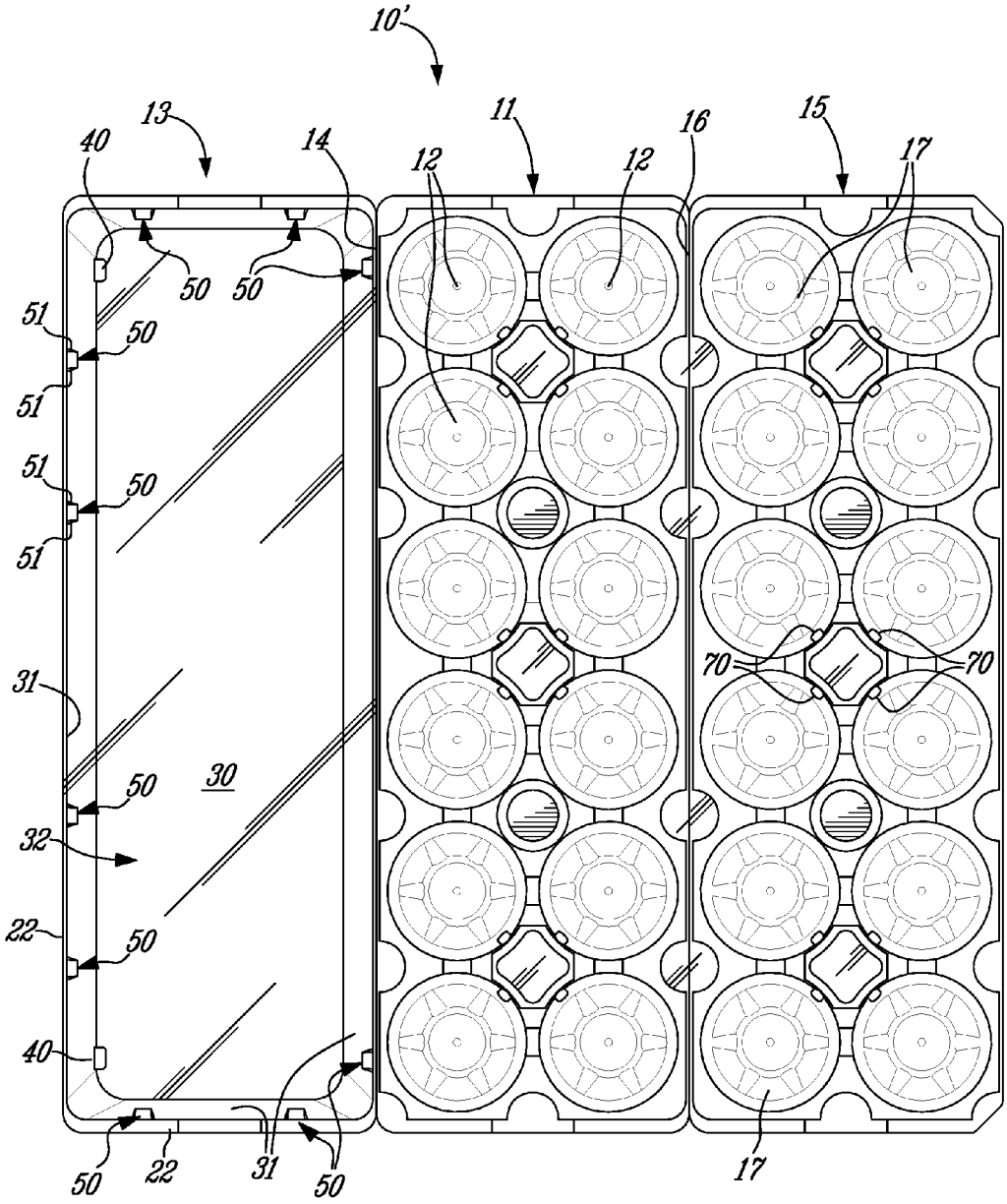
FIG. 3 is a top plan view of a three-fold egg container with a stack-spacing system in accordance with an embodiment of the present disclosure.
Figure 4:
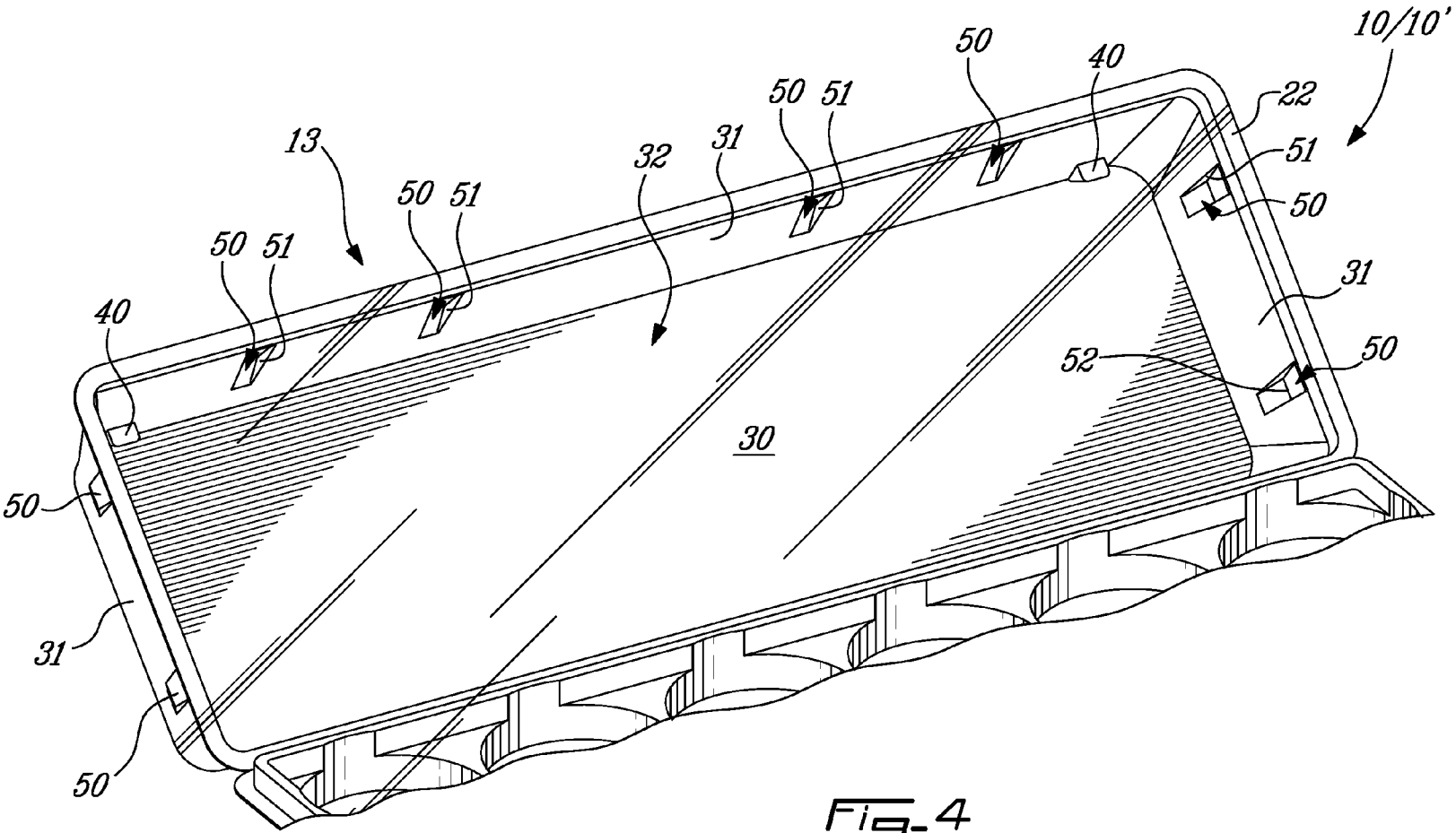
FIG. 4 is an enlarged fragmented view of a top cover portion of the egg container of FIG. 3.

Referring concurrently to FIGS. 3 and 4, a stack-spacing system is shown in the top cover portion 13, for the stacking of top cover portions 13. The stack-spacing system is present in a top cover portion of the type having a top wall 30 that is generally flat and horizontal when the egg container 10/10' is open or closed and rests on a horizontal surface. In FIGS. 3 and 4, the top wall 30 is illustrated as defining a single flat surface, but may alternatively be separated into multiple surfaces, or may be disrupted with ribs or other protuberances projecting into the top cover portion 13.

Peripheral walls 31 are provided between the top wall 30 and the peripheral flange 22. The peripheral walls 31 are concurrently tapered from the peripheral flange 22 to the top wall 30 for nesting of top cover portions 13 one into another. An inner concavity 32 of the top cover portion 13 is defined concurrently by the top wall 30 and the peripheral walls 31, and covers a top portion of frangible items received in the egg-receiving cavities 12 (FIGS. 1 and 2).

Components of the stack-spacing system are now described. The components are described with reference to the inner concavity 32. Due to the thin-wall nature of the material used in the containers 10/10', these components projecting into the inner concavity 32 are indentations from an exterior of the top cover portion 13.

Figure 6:
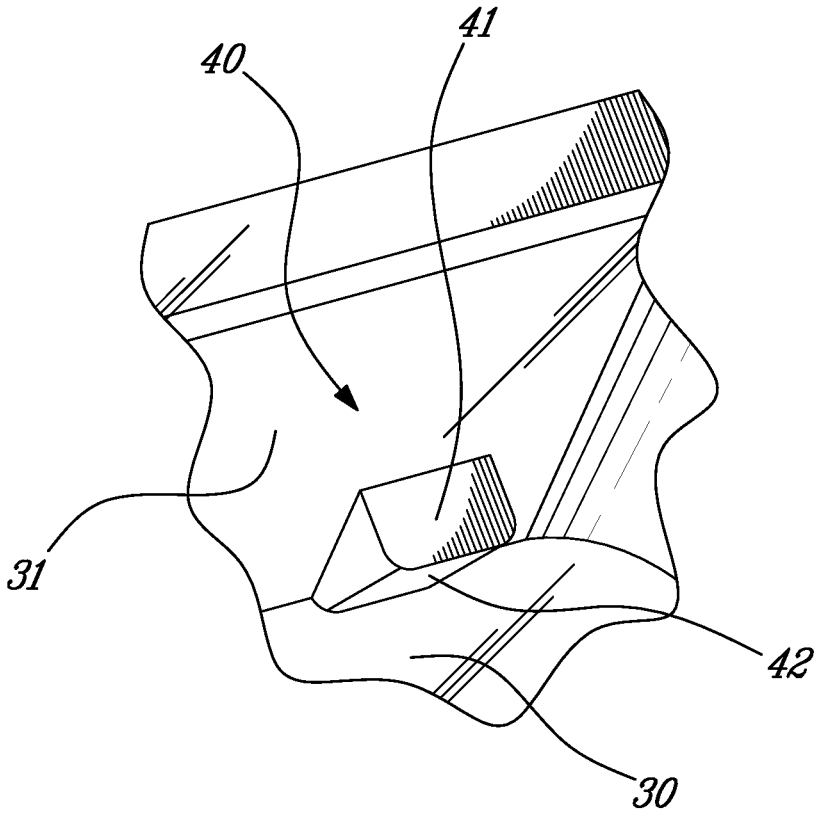
FIG. 6 is an enlarged perspective view of an abutment spacer of the stack-spacing system.

Referring to FIGS. 3, 4 and 6, abutment spacers 40 are provided in the inner concavity 32. In an embodiment, the abutment spacers 40 are at the intersection of the top wall 30 and the peripheral walls 31. Each of the abutment spacers 40 has an abutment surface 41 and support walls 42. The abutment surface 41 may be generally horizontal when the egg container 10/10' is closed or opened, whereas the support walls 42 are slanted. As best seen in FIG. 6, the support walls 42 taper toward the top wall 30, thereby defining an acute angle relation with the top wall 30, whether connected to the top wall 30 or distanced from the top wall 30. Therefore, the abutment spacers 40 are said to be negative spacers (i.e., negative stops). Accordingly, when the top cover portions 13 are nested one into the other, a top one of the abutment spacers 40 is seated on a bottom one of the abutment spacers 40. More specifically, an edge between the top wall 30 and the support wall 42 for the top one is seated on the abutment surface 41 of bottom one. The height of the support walls 42 is selected as a function of a desired spacing between top cover portions 13. More specifically, the height of the vertical surfaces 42 is selected as a function of the desired spacing between nested top cover portions 13, which spacing is for instance equal to the spacing between base portions 11 when nested one into the other.

The abutment spacers 40 may be positioned at any point along the edge between the top wall 30 and the peripheral walls 31, or in the peripheral walls 31. In one embodiment, the abutment spacers 40 are positioned at the edge that is farthest from the base portion 13. In placing the abutment spacers 40, a positioning of a label should be taken into consideration, as labels covering the full width of the top wall 30 are commonly used for identification, labeling and/or marketing purposes. As shown in FIG. 3, the positioning of the abutment spacers 40 at corners of the top cover portion 13 provides little interference for a wide label positioned therein.

The stack-spacing system of the top cover portion 13 also features a plurality of alignment channels 50 defined in the peripheral walls 31, which channels 50 may be from an interior or an exterior of the top cover portion 13, with a corresponding alignment protrusion formed on the other of the interior or exterior of the top cover portion 13, due to the fact that the container 10/10' is formed from a sheet. The alignment channels 50 are in the peripheral walls 31 so as to ensure that the abutment spacers 40 are vertically aligned when the top cover portions 13 are brought one into the other. This reduces the risk that the abutment spacers 40 of nested top cover portions 13 lock one into the other.

As seen in FIG. 3, the alignment channels 50 may have a tapering shape by way of edges 51 tapering from the peripheral flange 22 to the top wall 30. Accordingly, when one alignment channel 50 is lowered toward another alignment channel 50, the tapering edges 51 result in mating engagement and gradual alignment of the channels 50 one into the other. The tapering shape of the channels 50 also facilitates the denesting of a top cover portion 13 from another by pivoting movement about the base portion 11. The edges 51 may also be parallel to one another.

Figure 5:
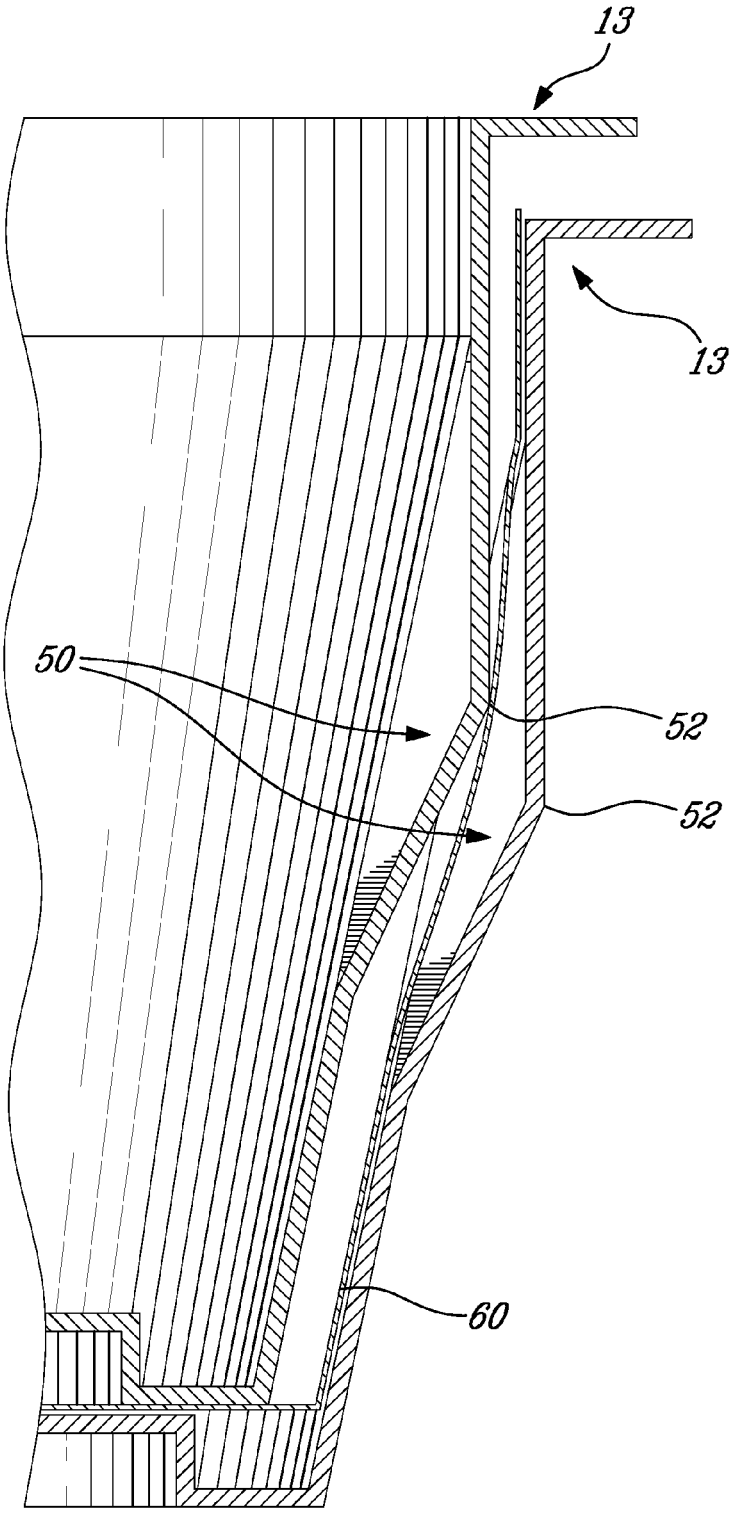
FIG. 5 is a sectional view of two of the top cover portions of FIG. 4, nested one into the other, with the stack-spacing system.

Referring to FIG. 5, the alignment channels 50 define a projecting portion such as a projecting edge 52, projecting toward an exterior of the peripheral walls 31. The projecting edges 52 are generally horizontal. The projecting edges 52 are used to ensure that the alignment channels 50 fit one into the other despite the presence of a label 60. More specifically, the projecting edge 52 of the top cover portion 13 nested into another will push the material of the label 60 into the alignment channel 50 of the bottom top cover portion 13. Alternatively, any shape of projection may be used. Although the projecting edges 52 are shown projecting toward the exterior as part of the channels 51, the projecting edges or portion 52 may extend into the concavity 32 if used with channels defined from an exterior of the egg container 10/10'.

Referring to FIG. 3, tear-shaped post spacers 70 are provided at central posts between four egg-receiving cavities 12. The spacers 70 define the spacing between base portions 11 nested one into the other and intermediate cover portion 15 nested into the other, if applicable. The tear-shaped spacers 70 are at four corners of the central posts, as the central posts are the main structural members inside the egg containers 10/10', and thus bear a substantial part of the weight of closed egg containers stacked thereon. The spacers 70 may be in the egg-receiving cavities 12, on the post, or at the intersection between cavities 12 and post. The tear shape of the spacers 70 is suited for spacers 70 to sit one on another, with the wide central section and narrower ends, along a vertical axis of the container 10/10'. In FIG. 3, the spacers 70 are in the form of a subcavity with respect to an interior of the container 10/10', and thus result in a bump from an exterior of the container 10/10', due to the generally uniform thickness of the sheet. However, the bump may be inward of the container 10/10' while the subcavity is outward of the container 10/10'.

In an embodiment of the present disclosure, the containers 10/10' are provided with all of the abutment spacers 40, the alignment channels 50 (and corresponding protrusions), and the post spacers 70. Although the egg containers 10/10' need not have all these components simultaneously, the stacking of open containers 10/10' featuring all of these components is efficient. The abutment spacers 40 and the post spacers 70 are concurrently sized so as to cause a uniform spacing between cover portions 13 and base portions 11, such that stacks of open containers 10/10' are substantially upright.

The invention claimed is:

1. A container for receiving frangible items comprising: a sheet of polymer formed into:

a base portion having a plurality of item-receiving cavities for supporting frangible items;

at least one cover portion having at least one item-covering concavity for covering the frangible items, the cover portion having a generally flat top wail and peripheral walls concurrently defining the at least one item covering concavity;

a first hinge between the base portion and the cover portion for rotation of the cover portion onto the base portion to hold the frangible items captive in the item-receiving cavities;

at least one abutment spacer formed proximate an edge between the peripheral walls and the top wall, the at least one abutment spacer comprising an abutment surface projecting into the concavity from one of the peripheral walls, and support walls relating the abutment surface to the top wall, at least one of the support walls being in an acute angle relation with the top wall; and at least one alignment channel in at least one of the peripheral walls defining an alignment protrusion through the sheet of polymer, the alignment channel being vertically offset from the at least one abutment spacer and oriented vertically to guide nesting of the cover portion into a similarly-configured cover portion with the alignment protrusion of the cover portion received in the alignment channel of the similarly-configured cover portion to form a stack of nested containers in an open position, whereby a spacing between the nested containers is defined by the at least one abutment spacer of the cover portion seated on the at least one abutment spacer of the similarly-configured cover portion, wherein the alignment channel has a projecting edge configured to hold a label captive in the cavity between the alignment protrusion of the cover portion and the alignment channel of the similarly-configured cover portion when the cover portion and the similarly-configured cover portion are nested together.

2. The container according to claim 1, wherein the abutment surface of the at least one abutment spacer is parallel to the top wall.

3. The container according to claim 1, wherein the edge proximate the at least one abutment spacer is disposed between the top wall and the peripheral wall opposite the first hinge.

4. The container according to claim 3, comprising two of said abutment spacer, the abutment spacers being located at opposed ends of the edge.

5. The container according to claim 1, comprising a plurality of the alignment channels, at least one of the plurality of alignment channels being disposed in each of said peripheral walls.

6. The container according to claim 1, wherein at least one edge of the at least one alignment channel tapers toward the top wall.

7. The container according to claim 1, further comprising a label in the concavity and covering at least partially the top wall and the peripheral walls.

8. The container according to claim 1, wherein the at least one alignment channel is disposed in the concavity, and the alignment protrusion is disposed on an exterior surface of the top cover portion.

9. The container according to claim 1, wherein the base portion has a post centered between each set of four of the item-receiving cavities, the post projecting upwardly from the base portion to support a structural component of the cover portion when the container is closed, and further comprising post spacers formed between at least one of the posts and the four item-receiving cavities surrounding the post, the post spacers each defining a subcavity on one side of the sheet of polymer and a bump on the other side of the sheet of polymer, the post spacers having a wider central portion for narrower ends along a vertical axis of the container, such that the nesting of an upper one of the base portion descending into a lower one of the base portion results in the post spacers of the upper one seated on the spacers of the lower one when a stack of the containers in an opened state is formed, whereby a spacing between nested base portions is defined at least by the post spacers of the upper one seated on the post spacers of the lower one.

10. The container according to claim 9, wherein the post spacers each have a teardrop shape.

11. The container according to claim 9, wherein the subcavities are disposed inside the container, and the bumps are disposed on an exterior surface of the base portion.

12. The container according to claim 1, further comprising: two of the cover portion, with an intermediate one of the cover portions having item-covering cavities for covering the frangible items on the item-receiving cavities;

a second hinge between the second longitudinal edge of the base portion, and the intermediate cover portion for rotating the intermediate cover portion onto the base portion, a top one of the cover portions being hinged about the first longitudinal edge to hold the base portion, the intermediate cover portion and the top cover portion in a closed configuration.

13. The container according to claim 1, wherein the frangible items are eggs, and each of the egg-receiving cavities receives one egg.

* * * * *

UNITED STATES PATENT AND TRADEMARK OFFICE

CERTIFICATE OF CORRECTION

PATENT NO. : 8,640,872 B2
APPLICATION NO. : 12/726634
DATED : February 4, 2014
INVENTOR(S) : Germain Archambault, Francois Blanchette and Francois St-Louis It is certified that error appears in the above-identified patent and that said Letters Patent is hereby corrected as shown below:

IN THE CLAIMS:

At column 5, line 44:

"portion having a generally flat top wail and peripheral" should read

- portion having a generally flat top wall and peripheral -

Signed and Sealed this
Third Day of June, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,640,872 B2
APPLICATION NO. : 12/726634
DATED : February 4, 2014
INVENTOR(S) : Germain Archambault, François Blanchette and François St-Louis It is certified that error appears in the above-identified patent and that said Letters Patent is hereby corrected as shown below:

IN THE CLAIMS:

At column 7, line 2:
"gible items are eggs, and each of the egg-receiving cavities" should read
-- gible items are eggs, and each of the item-receiving cavities --

Signed and Sealed this
Twenty-first Day of April, 2015

Michelle K. Lee

Michelle K. Lee
*Director of the United States Patent and Trademark Office*